United States Patent [19]

Bocker

[11] Patent Number: 4,633,427

[45] Date of Patent: Dec. 30, 1986

[54] ADVANCED CUBE PROCESSOR

[75] Inventor: Richard P. Bocker, San Diego, Calif.

[73] Assignee: The United States of America as represented by the Secretary of the Navy, Washington, D.C.

[21] Appl. No.: 626,506

[22] Filed: Jun. 29, 1984

[51] Int. Cl.[4] ..... G06G 7/16

[52] U.S. Cl. ..... 364/822; 350/162.12; 364/845; 364/813

[58] Field of Search ..... 364/819–822, 364/829, 830, 837, 841, 845, 713, 728, 754, 604, 606, 813; 350/96.11, 96.13, 96.14, 162.12, 162.13, 162.14, 356, 374, 388

[56] References Cited

U.S. PATENT DOCUMENTS

| | | | |
|---|---|---|---|
| 3,305,669 | 2/1967 | Fan | 364/845 |
| 4,286,328 | 8/1981 | Bocker | 364/822 X |
| 4,468,093 | 8/1984 | Brown | 364/822 X |
| 4,493,048 | 1/1985 | Kung et al. | 364/754 |
| 4,544,229 | 10/1985 | Verber | 364/822 X |
| 4,544,230 | 10/1985 | Caulfield | 364/822 X |

OTHER PUBLICATIONS

Athale et al—"Optical Matrix-Matrix Multiplier Based on Outer Product Decomposition"—Applied Optics—vol. 21, No. 12—Jun. 15, 1982—pp. 2089-2090.

*Primary Examiner*—Joseph Ruggiero

*Attorney, Agent, or Firm*—Robert F. Beers; Ervin F. Johnston; Thomas Glenn Keough

[57] ABSTRACT

An apparatus and method provide for the electrooptic performing of matrix-matrix multiplication, computation of the cross-ambiguity function and calculation of triple correlations. A collimated light source is pulsed to illuminate a first matrix of optically encoded information. Since the first matrix functions in the transmissive mode the same pulsed light is deflected by a polarizing beam splitter to a second matrix of optically encoded information. This matrix, functioning in the reflective mode reflects the pulsed, collimated light back through the beam splitter onto a third matrix of optically encoded information. The third matrix is operated in the reflective mode and reflects the pulsed, collimated light back to the polarizing beam splitter and onto a two-dimensional photodetector array. The photodetector array adds the successively arithmetically processed encoded informations from the first, second and third matrices of information. The information of the first matrix is advanced across the light path from the pulsed, collimated light source and the encoded information from the second and third matrices are advanced across opposite faces of the polarizing beam splitter in a mutually orthogonally displacement with respect to one another. Optionally, the information in the first matrix can be advanced across the path of the pulsed collimated light at right angles to that described above to effect substantially the same mathematical operations called for above.

10 Claims, 3 Drawing Figures

$$\underset{C}{\begin{pmatrix} c_{11} & c_{12} & c_{13} \\ c_{21} & c_{22} & c_{23} \\ c_{31} & c_{32} & c_{33} \end{pmatrix}} = \underset{A}{\begin{pmatrix} a_{11} & a_{12} & a_{13} \\ a_{21} & a_{22} & a_{23} \\ a_{31} & a_{32} & a_{33} \end{pmatrix}} \underset{H}{\begin{pmatrix} h_1 & 0 & 0 \\ 0 & h_2 & 0 \\ 0 & 0 & h_3 \end{pmatrix}} \underset{B}{\begin{pmatrix} b_{11} & b_{12} & b_{13} \\ b_{21} & b_{22} & b_{23} \\ b_{31} & b_{32} & b_{33} \end{pmatrix}}$$

ADVANCED CUBE PROCESSOR

STATEMENT OF GOVERNMENT INTEREST

The invention described herein may be manufactured and used by or for the Government of the United States of America for governmental purposes without the payment of any royalties thereon or therefor.

CROSS REFERENCE TO RELATED APPLICATIONS

This is related to a copending application entitled "Matrix-Matrix Multiplication Using an Electrooptical Systolic/Engagement Array Processing Architecture" by Richard P. Bocker, Henry J. Caulfield, and Keith Bromley, U.S. Patent and Trademark Office Ser. No. 581,168 filed Feb. 17, 1984, U.S. Pat. No. 4,603,398 and "Electrooptical Matrix Multiplication Using the Twos Complement Arithmetic for Improved Accuracy" by Richard P. Bocker, Stanley R. Clayton, and Keith Bromley, U.S. Patent and Trademark Office Ser. No. 612,288 filed May 21, 1984, U.S. Pat. No. 4,592,004.

BACKGROUND OF THE INVENTION

Significant new electrooptical signal processing techniques have recently been developed for improving the capabilities and utilization of information which may be expressed in electrooptic form. One recent electrooptical engagement array architecture has demonstrated a capability for performing matrix-matrix multiplication using collimated incoherent light. R. P. Bocker, H. J. Caulfield and Keith Bromley in their article entitled "Rapid Unbiased Bipolar Incoherent Calculator Cube" appearing in *Applied Optics, Vol.* 22, page 804 Mar. 15, 1983 disclose the essential components and mode of operation of this new signal-processing device. Their device represented an advance in the state-of-the-art and, as such, formed the subject matter of the first above referenced copending patent application and provided for new capabilities using non-coherent electrooptical analog techniques. In a later paper by R. P. Bocker, S. R. Clayton and Keith Bromley entitled "Electrooptical Matrix Multiplication Using the Twos Complement Arithmetic for Improved Accuracy" *Applied Optics,* Vol. 22, page 2019 July 1, 1983, a twos complement binary fixed-point arithmetic was applied to the electrooptical engagement array architecture to multiply two bipolar matrices with improved accuracy, this was the subject matter of the second above referenced copending patent application.

Having the basic architecture in hand, two recent publications, "Iterative Color-Multiplexed, Electro-Optical Processor" by D. Psaltis, D. Casasent, and M. Carlotto appearing in *Optical Letters* 4 on pages 348–350, November 1979 and R. P. Bocker's article entitled "Algebraic Operations Performable with Electro-Optical Engagement Array Processors", *Proceedings of the Society of Photo-Optical Instrumentation Engineers* 388, on pages 212–220, January 1983, indicate that other mathematical operations are feasible. These operations include higher-order matrix operations such as LU factorization, matrix inversions, and QR factorization achievable through repeated use of the matrix-matrix multiply operation; however, these additional procedures, sophisticated as they are, are limited by the described architecture that use only two matrices of encoded information.

Thus, a continuing need exists in the state-of-the-art for an updated electrooptical engagement array architecture having the capability for performing mathematical operations such as the computation of the cross-ambiguity function, and calculation of triple correlations.

SUMMARY OF THE INVENTION

The present invention is directed to providing an apparatus and method capable of electrooptically performing triple-matrix multiplication, that include H-matrix encoded information arranged in diagonal form. A source of pulsed collimated light illuminates a first matrix of optically encoded information. A second matrix of optically encoded information is illuminated by the same pulsed collimated light as the first matrix and a third matrix of optically encoded information is illuminated next by the same pulsed collimated light as were the first and second matrix. Advancing the encoded information across the first matrix simultaneously with the mutually orthogonal advance of optical encoded information across the second matrix with respect to the third matrix, allows the arithmetic processing of the information thereof in the form of a matrix-matrix multiplication, a computation of the cross-ambiguity function, as well as the calculation of triple correlations. Having the first matrix of optically encoded information provides as a result of operation in the transmissive mode and the information of the second and third matrices gathered as a result of operation in the reflective mode enables the simultaneous mathematical operation of the three matrices so that their product is respectively added in a two-dimensional photodetector array.

The prime object of the invention is to provide an improved electrooptical engagement array architecture capable of simultaneously arithmetically processing encoded information from three matrices.

Another object of this information is to provide for an improved electrooptical engagement array architecture having the information of one matrix provided by operation in the transmissive mode and the information of the second and third matrix provided by operation in the reflective mode.

Yet another object of the invention is to provide an electrooptical engagement array architecture having the encoded information content of a second matrix and a third matrix sequentially advanced in a mutually orthogonally disposed relationship to allow the multiplication and adding thereof, while simultaneously the information from a first matrix is advanced across the correlation grid of the second and third matrix in one of two directions.

Still another object of the invention is to provide an electrooptical engagement array architecture having a polarizing beam splitter receiving pulsed collimated light after it passes through a first matrix of information provided in a transmissive format to enable the directing of light reflected to and from a second matrix to and from a third matrix of encoded information and onto a photodetector array.

A further object of the invention is to provide for an electrooptic engagement array architecture having a spatial light modulator functioning in the transmissive mode to display optically encoded information and a second and a third spatial light modulator operating in the reflective mode to enable the simultaneous arithmetic multiplying of the encoded information of the three matrices.

Still another object is to orient the H matrix information so that it coincides with the A or B matrix information as the information is advanced during mathematical processing.

These and other objects, advantages and novel features of the invention will become apparent from the following detailed description of the invention when considered in conjunction with the accompanying drawings.

BRIEF DESCRIPTION OF THE DRAWINGS

FIG. 2*a* depicts a second orientation of the first matrix of encoded information capable of performing the desired mathematical operations.

DESCRIPTION OF THE PREFERRED EMBODIMENT

Figures 1, 2:
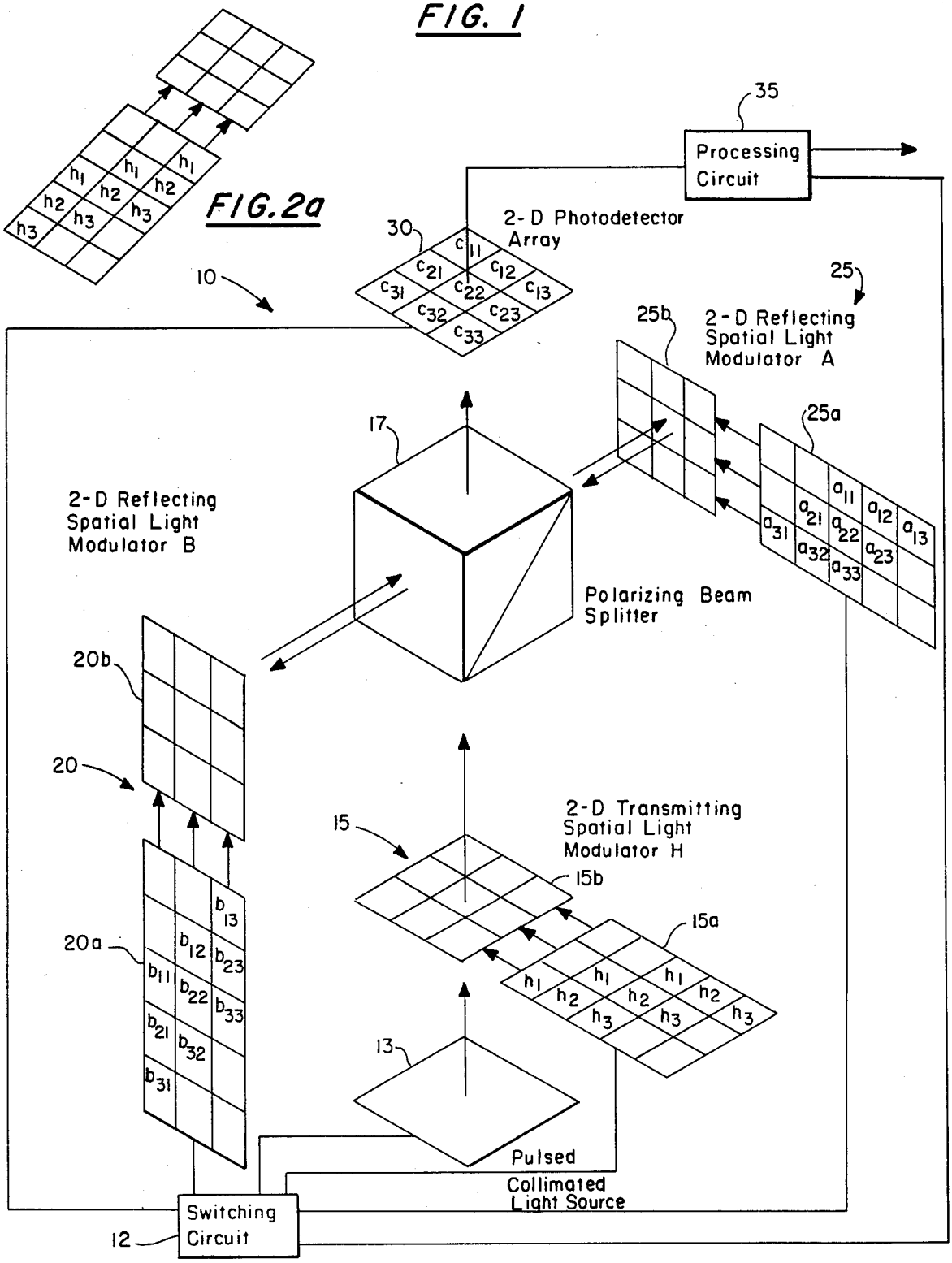
FIG. 1 shows a representation of three matrices of encoded information and the desired output matrix.
FIG. 2 shows an advanced electrooptical engagement array architecture capable of enabling matrix-matrix multiplication, computation of the cross-ambiguity function, and calculation of triple correlations.

Referring to FIG. 1 of the drawings, mathematical operations involving the information of three matrices A, B and H can be performed to arrive at a composite matrix as represented by matrix C. The matrices are all of the order three for the purposes of demonstration only, it being understood that the matrices can be expanded as needed to perform the desired mathematical operations.

The improved systolic engagement array processing architecture 10 is set forth in a block diagram form in FIG. 2 that is capable of processing the matrix arrangement of FIG. 1. The architecture is similar to a degree as that described in the two copending patent applications cited above and the first two articles in the Background of the Invention.

A sequential processing of the information content of the matrices depends on a sequential actuation of the elements of the architecture by an electronic switching circuit 12. The circuit is no more than a timed switch that delivers a series of enabling pulses for its electrically connected elements and, as such, it can be routinely fabricated by one skilled in the art to which this invention pertains without the exercise of any creative effort or undue experimentation. Collimated light source 13 is connected to the switching circuit to provide collimated pulses of light for the rest of the architecture. The light source is any one of a variety of noncoherent sources, such as a light emitting diode or a laser diode, that may be actuated upon the simple receipt of an actuation pulse from the electronic switching circuit and a suitable lens arrangement is provided to assure collimation of the pulsed light.

Pulsed collimated light emanating from the source passes through a two-dimensional light modulator 15 operating in the transmissive mode. A laterally displaceable mask 15*a* is coupled to switching circuit 12 and when enabling pulses are received thereby, the information encoded in cells $h_1$, $h_2$ and $h_3$ are laterally shifted one unit per pulse. The information of the cells are encoded in analog. The mask may be a suitably processed mechanically advanced film, or the like. It can be a liquid crystal when the light is also polarized, or any other material that can have its transmissivity altered to represent information and is capable of being laterally advanced by suitable impulses. The information encoded in the mask 15*a* is advanced across a grid 15*b* one unit at a time each time the collimated light source is pulsed.

A polarizing beam splitter 17, any one of a number of commercially available units, receives the pulsed light coming through modulator 15 and passes it to a second matrix of optically encoded information encoded in a two-dimensional reflecting spatial light modulator 20.

For the purposes of understanding the invention, the two-dimensional reflecting spatial light modulator 20 can be said to have a laterally displaceable mask 20*a* that is encoded with optical information. This mask is coupled to electronic switching circuit 12 to enable the lateral displacement of the information of the mask across a reflective surface 20*b* that backs the laterally displaceable mask. Pulsed collimated light emanating from the pulsed collimated source 13 impinges on the modulator 20, after passing through spatial light modulator 15 and through polarizing beam splitter 17. The pulsed light then is reflected back through the polarizing beam splitter onto a third two-dimensional reflecting spatial light modulator 25.

Like modulator 20, this modulator has optically encoded information on a laterally displaceable mask 25*a* that passes across a reflective surface 25*b*. It should be noted that the relative directions of travel of the information on the mask containing the information in the spatial light modulator 20 and the spatial light modulator 25 is mutually orthogonal with respect to one another. After the light has been reflected from the surface 25*b* it once again enters the polarizing beam splitter which directs it to a two-dimensional photodetector array 30 such as a photo activated two-dimensional charge coupled device or an array of photodiodes. The array adds sequential pulses of the pulsed collimated light that is affected by modulation 15, 20 and 25. From there the optical information is transformed into representative electrical signals that are appropriately gated out by switching circuitry 12 fo interconnected circuitry 35.

Each of the two-dimensional spatial light modulators 20 and 25 that in this case operate in a reflective mode could be a pair of CCD spatial light modulators using the electro absorption (FRANZ-KELDYSH) effect in GaAs as disclosed by R. H. Kingston, B. E. Burke, K. B. Nichols, and F. J. Leonberger in "Spatial Light Modulation Using Electroabsorption in a GaAs Charge-Coupled Device", *Applied Physics Letters* 41 413(1982). 2-D CCD spatial light modulators appear particularly attractive since they are potentially capable of being clocked at rates in excess of 1 GHz. Optionally both the spatial light modulators could be planar surfaces having a film or other suitably configured mask appropriately provided with appropriate analog signal representations. Suitably arranged parallel strips of acousto driven BRAGG cells can be adapted to function as the mask material. They have the capability of being rapidly shifted and changed to provide the necessary patterns to indicate analog representations of matrix numbers.

The electronic switching circuit initiates the pulsing of source 13 and simultaneously advances modulators 15, 20 and 25 one matrix element per pulse. The advance of the modulators 20 and 25 is orthogonal. Modulator 15 advances to align its information with the advance of information with that of modulator 25 in the same switching sequence so that the $h_1$, $h_2$, $h_3$ information coincides with the A information. Rotating modulator 15 90° as shown in FIG. 2*a* allows the advance of the information of the H matrix to coincide with the advance of the information of matrix B on modulator 20. The mathematical operation is equivalent with the orientation of the matrix H information as described. Care must be exercised not to have the orientation otherwise than described.

The simultaneous pulsing of the light source with the alignment of elements of matrix H, A and B effects a multiplication of the information encoded thereon. The light responsive cells of the aligned photodetector array will receive the multiplied pulses and accumulate or add sequentially pulse-multiplied products of matrix H,A and B encoded numbers until the matrix mathematical operation is complete. Then the added information is switched out of the array 30 by appropriate switching signals from 12 into processing circuit 35 for further processing. The further processing can be decoding to one useable form or another.

Collimating and imaging optics, as well as polarizers and wave plates, may be required but are not shown to avoid belaboring the obvious. The exact electrooptical configuration of accessories required would be highly dependent on the actual spatial light modulators employed in the processor since several different types are envisioned it would be well within the purview of a routineer to make the appropriate provisions.

The architecture shown in FIGS. 2 and 2*a* would allow for the matrix multiplying operation set forth in FIG. 1 (although the matrices shown are of the order 3 the technique disclosed and described herein will apply to matrices of an order greater than 3).

The matrices set forth in FIG. 1 is equivalent to the equation $$C=AHB \tag{1}$$

where A, H and B are known input matrices and C is the desired output matrix. Each element of the matrix C is obtained by the equation $$C_{mn} = \sum_k a_{mk}h_kb_{kn} \tag{2}$$

With this expression a number of mathematical operations are described. The first example concerns matrix-matrix multiplication. This is easily visualized by allowing $$h_k=1(\text{all } k) \tag{3}$$

When the conditions of this equation are present then the equation 1 reduces to $$C_{mn} = \sum_k a_{mk}b_{kn} \tag{4}$$

or more simply stated $$C=AB \tag{5}$$

Equation (5) simply describes the multiplication of two arbitrary matrices A and B. Setting H equal to the identity matrix I is equivalent to removing the transmitting two-dimensional spatial modulator 15 of FIG. 2. It comes as no surprise that the resulting architecture is no more than the electrooptical engagement array architecture described above and referred to in the first cross referenced patent application.

However, in addition to the already demonstrated capability, the configuration of this improved architecture is capable of the computation of the cross-ambiguity function. The cross-ambiguity function associated with two signals u(t) and v(t) is defined by $$X(s,f)=\int u(t)v^*(t-s)\exp(-i2\pi ft)dt \tag{6}$$

where i is equal to the square root of −1.

The cross-ambiguity function and its usefulness has been described by P. M. Woodward in *Probability and Information Theory with Applications to Radar* (Pergammon, London, 1953). The ambiguity function describes the resolution properties, the ambiguities, the measurement precision, and the clutter rejection properties of radar signals. This function has proved to be an indispensable tool for radar signal designers.

Because of its importance there have been a number of optical schemes proposed and tested for implementing the computation of this function. Typical of such schemes are the examples "Optical Data Processing and Filtering Systems" by L. J. Cutrona, E. N. Leith, C. J. Palerno, and L. J. Porcello, *IRE Transactions Infinite Theory IT*-6 on pages 386 et seq (1960), "Optical Processing of Pulsed Doppler and FM Stepped Radar Signals" by D. Casasent and F. Casasayas, *Applied Optics* 14, pages 1364 et seq (1975), "Ambiguity Function Display: An Improved Coherent Processor", R. J. Marks, J. F. Walkup, and T. F. Krile, *Applied Optics* 16, pages 746 et seq (1977) and "Ambiguity Processing by Joint Fourier Transform Holography" by T. C. Lee, J. J. Rebholz, P. N. Tamura, and J. Lindquist, *Applied Optics* 19, pages 895 et seq (1980).

In terms of a discrete representation equation 6 may be expressed as $$X_{mn}=\sum_k u_kV_{k-m}\exp(-i2\pi nk/N) \tag{7}$$

which is equivalent to equation 2 if $$\left.\begin{aligned} a_{mk} &= V^*_{k-m} \\ h_k &= u_k, \\ b_{kn} &= \exp(-i2\pi nk/N). \end{aligned}\right\} \tag{8}$$

A third example of a mathematical operation which may be described by equation 2 is that of triple correlation as discussed by A. W. Lohmann in his article entitled "Chances for Optical Computing" *International Optical Computing Conference Digest, IEEE Catalog* 83CH1880-4 pages 1–5 (MIT, Cambridge, Mass., April 1983).

The autotriple correlation is defined by $$T(x,y)=\int u(x')u(x'+x)u(x'+y)dx' \tag{9}$$

the usefulness of the triple correlation T(x,y) occurs when the signal u(x') is in the presence of additive noise whose probability function is symmetrical. Under these conditions, the triple correlation is insensitive to noise. The corresponding discrete version of equation 9 is given by $$T_{mn} = \sum_k u_k u_{k+m} u_{k+n} \tag{10}$$

which is equivalent to equation 2 if $$\left.\begin{aligned} a_{mk} &= u_{k+m}, \\ h_k &= u_k, \\ b_{kn} &= u_{k+n}. \end{aligned}\right\} \tag{11}$$

Obviously many modifications and variations of the present invention are possible in the light of the above teachings. It is therefore to be understood that within the scope of the appended claims the invention may be practiced otherwise than as specifically described.

What is claimed is:

1. An apparatus capable of electrooptically performing triple-matrix multiplication, including an H-matrix of optically encoded information of numbers in diagonal form comprising:

a source of pulsed collimated light;

first means aligned to be illuminated by pulsed collimated light from the source for providing the H-matrix of optically encoded information of numbers arranged in diagonal form that are laterally shifted each time the source is pulsed;

second means disposed to be illuminated by the same pulsed collimated light from the source after the first H-matrix providing means has been illuminated thereby for providing a second matrix of optically encoded information of numbers;

third means disposed to be illuminated by the same pulsed collimated light from the source after the first H-matrix providing means and the second matrix providing means have been illuminated thereby for providing a third matrix of optically encoded information of numbers, wherein the second matrix providing means and the third matrix providing means are oriented and coupled to be mutually orthogonally displaced with respect to one another to optically align different encoded information of numbers each time the light source is pulsed to enable an arithmetic processing thereof;

means disposed in an optically aligned relationship with the first H-matrix providing means, the second matrix providing means and the third matrix providing means for adding successively arithmetically processed encoded information of numbers of the first H-matrix providing means, the second matrix providing means and the third matrix providing means.

2. An apparatus according to claim 1 further including:

a polarizing beam splitter located to receive the pulsed collimated light from the source after it passed through the first H-matrix providing means and direct it to the second matrix providing means and to direct light reflected therefrom to the third matrix providing means and to redirect light reflected from the third matrix providing means to the adding means; and switching means coupled to the first H-matrix providing means, the second matrix providing means and the third matrix providing means for effecting the lateral shifting and mutual orthogonal displacement thereof.

3. An apparatus according to claim 2 in which the first H-matrix providing means is a two-dimension spatial light modulator operating in a transmissive mode and the second and third matrix providing means each include a reflective surface behind a two-dimension spatial light modulator to operate in the reflective mode and advance their encoded information of numbers mutually orthogonal with respect to each other each time the light source is pulsed.

4. An apparatus according to claim 3 in which the information of the first H-matrix is orientated and disposed to coincide with the information of the second matrix as the information from both matrices is advanced during the desired mathematical processing.

5. An apparatus according to claim 3 in which the information of the first H-matrix is orientated and disposed to coincide with the information of the third matrix as the information from both matrices is advanced during a desired mathematical processing.

6. A method of electrooptically performing triple-matrix multiplication, including an H-matrix of optically encoded information of numbers in diagonal form comprising:

pulsing a collimated light source;

illuminating a first H-matrix of optically encoded information of numbers arranged in diagonal form with pulsed collimated light;

optically aligning a second matrix of optically encoded information of numbers with respect to the first H-matrix;

illuminating the second matrix of optically encoded information of numbers with the same pulsed light that illuminated the first H-matrix;

optically aligning a third matrix of optically encoded information of numbers with respect to the first H- and second matrix;

illuminating the third matrix of optically encoded information of numbers with the same pulsed light that illuminated the first H- and second matrix;

laterally displacing the first H-matrix and mutually orthogonally displacing the second matrix with respect to the third matrix to optically align different encoded information of numbers each time the light source is pulsed to enable the optical processing thereof;

aligning an array responsive to light for generating representative signals to receive the arithmetically processed numbers from the first H-matrix, second matrix and third matrix;

adding successively arithmetically processed encoded information of numbers of the first H-matrix, the second matrix and the third matrix.

7. A method according to claim 6 further including:

locating a polarizing beam splitter to receive pulsed collimated light from the pulsed collimated source after it has passed through the first H-matrix of encoded information to direct the pulsed collimated light to the second matrix and to direct light reflected therefrom to the third matrix and to redirect light reflected from the third matrix to the array.

8. A method according to claim 7 further including:

transmitting pulsed collimated light through the first H-matrix to permit operation thereof in the transmissive mode and providing a reflective surface behind a two-dimension spatial light modualtor for the second matrix and third matrix to permit the operation thereof in the reflective mode.

9. A method according to claim 8 further including: orienting the disposition of the information of the first H-matrix to coincide with the information of the second matrix as the information from both matrices advances during a desired mathematical processing.

10. A method according to claim 8 further including: orientating the disposition of information of the first H-matrix to coincide with the information of the third matrix as the information from both matrices advances during a desired mathematical processing.

* * * * *